United States Patent [19]

Russell et al.

[11] 4,026,775

[45] May 31, 1977

[54] ELECTROCOATING BATH TEMPERATURE CONTROL

[75] Inventors: Edward A. Russell, Bay Ridges, Canada; Richard L. Knipe, Orinda; James E. Leaver, Alamo, both of Calif.

[73] Assignee: Kaiser Aluminum & Chemical Corporation, Oakland, Calif.

[22] Filed: Nov. 13, 1975

[21] Appl. No.: 631,758

Related U.S. Application Data

[63] Continuation of Ser. No. 448,780, March 6, 1974, abandoned.

[52] U.S. Cl. ..... 204/181; 204/299 EC; 165/2

[51] Int. Cl.[2] ..... C25D 13/00; F28D 7/00

[58] Field of Search ..... 204/181, 299 EC, 300 EC; 165/2, 172

[56] References Cited

UNITED STATES PATENTS

| | | | |
|---|---|---|---|
| 3,355,373 | 11/1967 | Brewer et al. | 204/181 |
| 3,476,176 | 11/1969 | Hardison | 165/2 |

*Primary Examiner*—T. Tung
*Attorney, Agent, or Firm*—Paul E. Calrow; Edward J. Lynch

[57] ABSTRACT

This invention relates to an improved method and system for controlling the temperature of an electrocoating bath wherein the bath is passed through a heat exchanger wherein the heat exchange surfaces in contact with the bath do not exceed 180° F.

2 Claims, 2 Drawing Figures

ELECTROCOATING BATH TEMPERATURE CONTROL

This is a continuation of application Ser. No. 448,780, filed Mar. 6, 1974 now abandoned.

BACKGROUND OF THE INVENTION

This invention generally relates to an improved method of electrodepositing a water-soluble or water-dispersible coating resin onto a conductive surface, and, in particular, is directed to a method and system for controlling the temperature of the electrocoating bath within the temperature range of about 90°–135° F.

The electrodeposition of water-based coatings commonly termed electrocoating is a widely used process which has many advantages over other methods of coating, such as spraying, dipping, rolling and the like. The advantages of electrocoating are well known. The process deposits a film of uniform thickness on essentially any conductive surface, even those which have sharp points and edges. Electrocoated film when applied is relatively water free and thus will not run or drip when taken out of the bath. Because little or no organic solvents are used in the resin system, the process is essentially fumeless and requires no extensive fume collection and incineration equipment. This latter point is important in view of the increased concern over environmental pollution. An additional advantage is the fact that a second or top coat can be applied over the electrocoated film without curing the electrocoated film and then both coats can be cured in one baking operation. By limiting the necessity of two baking furnaces, the cost of a two-coat process can be considerably reduced.

Electrocoating process generally comprises immersing the article to be coated into the electrocoating bath, usually as the anode, and passing a current through the bath between the article and electrode. The process usually is self-arresting in that as the thickness of the coating increases, the resistance thereof also increases, thereby limiting the amount of coating which is deposited.

During electrocoating, a considerable quantity of heat is generated in the bath which must be removed or dissipated in some manner so as to maintain the bath temperature at the desired level. Most commercial electrocoating installations, which maintain the electrocoating bath temperature at around ambient temperature, have extensive refrigeration equipment to maintain the bath temperature at around ambient levels. A higher temperature bath, e.g., 90 to about 135, would be more desirable because the higher temperature bath would allow for the use of tap water as a coolant and moreover provide a more efficient electrocoating process due to the acceleration of electroendosmosis at the higher temperatures. Notwithstanding the advantages of a high temperature bath, most commercial facilities employ a room temperature bath to eliminate the problems associated with preheating the bath prior to the start of electrocoating. It was found that heating elements tended to be quickly coated with a cured or semicured layer of resin which rendered the heating element more or less ineffective and frequently useless. It would be conceivable to utilize the heat generated during electrocoating to bring the bath temperature up to the desired level, but all of the material electrocoated during this period would have to be scrapped due to its low quality. In electrocoating processes wherein there is a large bath volume-to-workpiece area ratio, preheating the bath in this manner to the higher level would be prohibitive due to the excessive amounts of scrap which would be generated. Against this background, the present invention was developed.

DESCRIPTION OF THE INVENTION

The present invention is directed to an improved method of controlling the temperature of a high temperature electrocoating bath, and, in particular, to heating an electrocoating bath to an operating temperature between about 90° and 135° F prior to start-up.

In accordance with the present invention, the electrocoating bath is passed through an indirect heat exchanger wherein the temperature of the heat exchange surfaces does not exceed 180° F, preferably less than 150° F. In one embodiment of the present invention, the heating and cooling systems are integrated to provide one operative system. It is preferred to use tap water as the heat exchange fluid because it is readily available and because it facilitates the integration of the heating and cooling systems. The temperature of the cooling medium should be below about 90° F.

Figure 1:
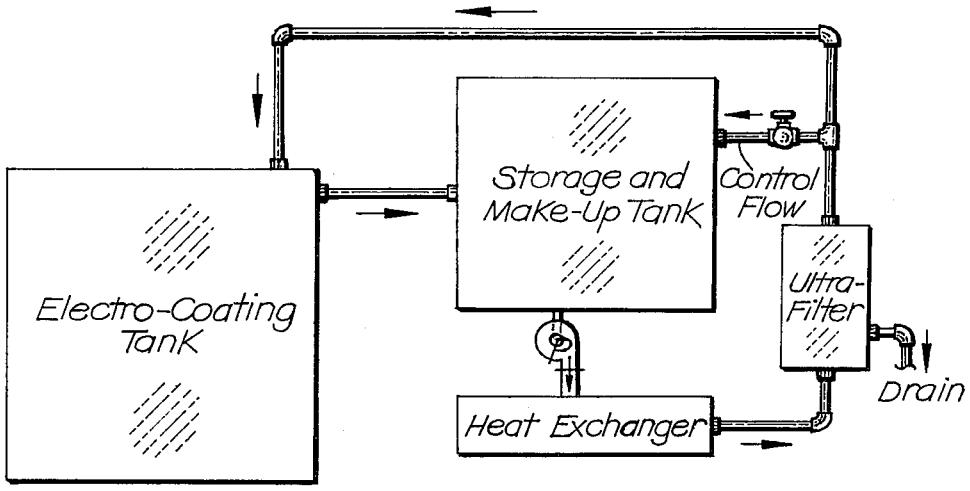
FIG. 1 is a schematic drawing of the overall bath treatment facilities.

Reference is made to FIG. 1 which is a schematic diagram of the electrocoating tank and the bath treating facilities. Electrocoating bath is continuously withdrawn from the electrocoating tank and transferred to a storage or make-up tank. Bath from the storage or make-up tank is withdrawn and pumped through a heat exchanger to control the temperature at the desired operative levels and then to an ultrafilter wherein low molecular weight materials are removed from the bath. The permeate or ultrafiltrate from the ultrafilter, which contains low molecular weight materials, such as organic amines and the like, can be discarded to the drain as shown or further treated to recover the low molecular weight species therein. The treated bath can be transferred back to the holding and make-up tank, returned directly to the electrocoating tank or proportioned therebetween.

Figure 2:
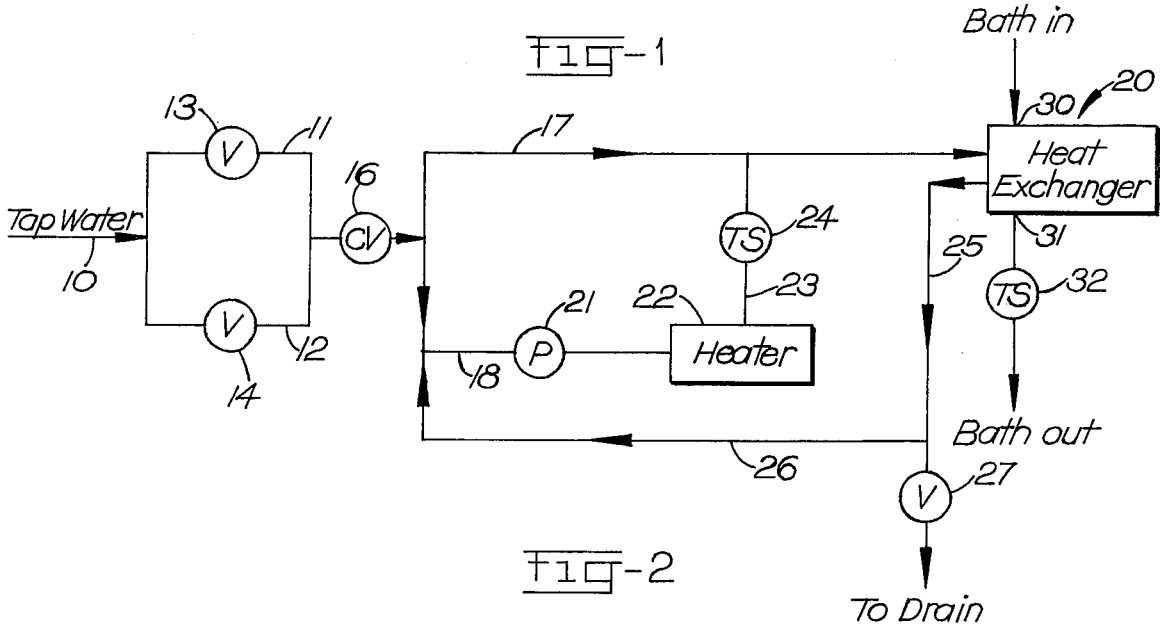
FIG. 2 is a schematic drawing of the temperature control system of the present invention.

In FIG. 2, the features of the present invention are shown in greater detail. As shown in this figure, tap water (or other cool heat exchange fluid) is introduced into line 10 which is split into conduits 11 and 12 containing valves 13 and 14, respectively. These conduits rejoin into a conduit containing a check valve 16 which is in fluid communication with conduits 17 and 18. Conduit 17 directs the tap water directly to the heat exchanger 20. Conduit 18 directs the tap water to pump 21 which is in fluid communication with heater 22. The heated heat exchange fluid passes through conduit 23 which contains temperature sensing element 24 which is utilized to sense the temperature of the heat exchange fluid and thereby control the temperature at the desired level. Conduit 23 is in fluid communication with conduit 16 so as to direct heat exchange fluid to the heat exchanger 20. Heat exchange fluid exits the heat exchanger 20 through conduit 25 which can direct the expended heat exchange medium to the drain or return to the pump 21 through conduit 26 depending upon whether valve 27 is open or closed. The electrocoating bath enters the heat exchanger 20 at inlet 30, passes in an indirect heat exchange relationship with the heat exchange medium and then out of the heat exchanger through outlet 31 where the temperature of the electrocoating bath is sensed by temperature sensor 32. The indirect heat exchange device can be of any convenient design, such as a conventional shell and tube-type heat exchanger.

For improved bath temperature control, it is preferred in the present invention to automatically control the heating and cooling system. This can be conveniently accomplished by utilizing the temperature sensed by sensor 32 for control purposes. Thus, for heating when the temperature of the bath is below a desired level, valves 13 and 27 will be automatically closed, valve 14 automatically opened and pump 21 and heater 22 automatically activated, all in response to the temperature sensed by sensor 32. For cooling when the bath temperature is above a desired level, valves 13 and 27 would automatically be opened, valve 14 automatically closed and pump 21 and heater 22 automatically deactivated in response to the temperature signal. The system shown in FIG. 2 was designed to employ an automatically adjustable valve 13 to provide closer control of the bath temperature by providing a continuous operation rather than an on-off type cooling system. The valves 14 and 27 can be conventional open-closed, solonoid-operated valves. With the use of an automatically adjustable valve 13, the temperature sensor 32 generally will provide two signals, one an on-off or open-closed signal to operate valves 14 and 27, pump 21 and heater 22 and a second signal which adjusts valve 13 so as to provide the coolant flow necessary to control the bath temperature at the desired level. This latter signal, in accordance with conventional practice, will be compared by suitable means with a signal representing the desired bath signal and by control means responsive to the error signal generated by the comparator control position of valve 13. Preferably, sensor 32 comprises two sensing elements, one which generates the on-off signal or open-closed signal and the other the signal for controlling valve 13. A suitable on-off open-closed sensing element is Honeywell Temperature Controller Model T654A1602. Adjustable valve 13 can be a Fulton Silphon valve manufactured by the Fulton Valve Corporation. The solonoid valves are of a conventional nature.

During the start-up of electrocoating operations, the bath temperature will be below the desired level for high temperature operation. In that instance, the temperature sensor 32 will direct a suitable signal to close valve 13, open valve 14, and actuate the pump 21 and the heater 22. The tap water or other heat exchange fluid will then pass through valve 14, pump 21, and heater 22, where it is heated and then passed to the heat exchanger 20. The temperature of the heated fluid is controlled so that the heat exchange surfaces in the heat exchanger 20 do not exceed 180° F, preferably less than 150° F. The check valve located in line 15 precludes back flow of water into the supply system. Little or no fluid is introduced into the system except that needed for make-up. Upon discharging from the heat exchanger, the expended heated fluid then returns to the pump 21 through conduit 26.

As soon as the temperature of the electrocoating bath reaches the desired operating level, the electrocoating process is started. The bath immediately begins to heat up due to the normal heat input of the electrocoating process. When the temperature reaches a predetermined level, the temperature sensor 32 generates a second signal which activates the cooling system. Valve 14 closes and valve 13 opens. Pump 21 and heater 22 are shut off. Valve 27 to the drain is opened. The cool tap water or other cool heat exchange medium then passes directly to the heat exchanger through conduit 16 and the expended heat exchange fluid is discarded through conduit 25 and valve 27. The volume of tap water or other heat exchange medium through valve 13 is automatically controlled by suitable means in accordance with the temperature sensed by temperature sensor 32.

If for some reason the electrocoating process is shut down, e.g., for repairs and the like, the system will automatically switch off the cooling system when the temperature of the bath is reduced below a predetermined minimum level and the heating system will be activated. The heating system thereby maintains the temperature of the bath at the desired levels during the downtime so that no delays occur during start-up and most importantly no significant amount of scrap is generated because efficient electrocoating begins immediately.

The following is given as an example of the present invention utilizing the system shown in FIG. 2. Prior to startup of the electrocoating operations, the bath is at ambient temperature and tap water at about 60° F is directed to a heater wherein the temperature is raised to about 110° F. The heated water is passed through a shell and tube-type heat exchanger and in an indirect heat exchange relationship with the electrocoating bath to heat the bath. When the temperature sensor determines that the bath temperature is at an operating level at about 108° F, the heating system is deactivated and the electrocoating process is started. Shortly thereafter, due to the heat generated by the electrocoating process, the bath temperature rises. When the temperature rises 1° F above the operating level, the cooling system is activated and tap water is directed to the heat exchanger for cooling purposes.

Close control of the electrocoating bath temperature is essential because the rates of the various electrocoating phenomena, such as electrophoretic deposition, electrocoagulation, electroendosmosis and the like, are all temperature dependent. Small changes in temperature can generate significant changes in the electrocoating process. It is preferred to maintain bath temperature variation during operations to less than 2° F from a desired temperature.

It is obvious that various modifications and improvements can be made to the present invention without departing from the spirit of the present invention and the scope of the appended claims.

What is claimed is:

1. In the process of electrocoating resinous material onto a metal substrate wherein the temperature of the electrocoating bath containing said resinous material is maintained within the range from 90° F to about 135° F, the improvement in the process of controlling the temperature of the bath comprising a. withdrawing electrocoating bath from a tank containing same;

b. sensing the temperature of the electrocoating bath;

c. passing withdrawn bath through a heat exchange device in an indirect heat exchange relationship with heat exchange fluid flowing therethrough, with the temperature of the heat exchange fluid being controlled so that the temperature of the surfaces of the heat exchange device in contact with the electrocoating bath does not exceed 150° F;

d. supplying all of the heat exchange fluid from a single source thereof, wherein the temperature of the heat exchange fluid from said source is less than 90° F;

e. controlling the temperature of the bath at a level within the range from 90° F to about 135° F in the following manner:

i. if the sensed bath temperature exceeds a predetermined maximum temperature between 90° and about 135° F, directing cool heat exchange fluid to the heat exchange device to reduce the temperature of the bath to at least the predetermined maximum temperature, with at least part of said cool heat exchange fluid coming directly from said source;

ii. if the sensed bath temperature is less than a predetermined minimum temperature between 90° and about 135° F, passing heat exchange fluid through a heating device to raise the temperature thereof and then directing the heated heat exchange fluid to the heat exchange device to raise the temperature of the bath to at least the predetermined minimum temperature.

2. The method of claim 1 wherein at least part of the heat exchange fluid which is passed through the heating device comprises heat exchange fluid discharged from the heat exchange device.

* * * * *